US011522301B2

(12) United States Patent
Wu et al.

(10) Patent No.: US 11,522,301 B2
(45) Date of Patent: Dec. 6, 2022

(54) ANTENNA STRUCTURE AND WIRELESS COMMUNICATION DEVICE USING SAME

(71) Applicants: Futaijing Precision Electronics (Yantai) Co., Ltd., Yantai (CN); FIH (HONG KONG) LIMITED, Kowloon (HK)

(72) Inventors: Ching-Ling Wu, New Taipei (TW); Hsiang-Neng Wen, New Taipei (TW); Chi-Sheng Liu, New Taipei (TW); Yung-Yu Tai, New Taipei (TW)

(73) Assignees: Futaijing Precision Electronics (Yantai) Co., Ltd., Yantai (CN); FIH (HONG KONG) LIMITED, Kowloon (HK)

( * ) Notice: Subject to any disclaimer, the term of this patent is extended or adjusted under 35 U.S.C. 154(b) by 0 days.

(21) Appl. No.: 17/228,952

(22) Filed: Apr. 13, 2021

(65) Prior Publication Data

US 2022/0094077 A1 Mar. 24, 2022

(30) Foreign Application Priority Data

Sep. 21, 2020 (CN) ..... 202010998162.4

(51) Int. Cl.
*H01Q 21/26* (2006.01)
*H01Q 1/22* (2006.01)

(52) U.S. Cl.
CPC ..... *H01Q 21/26* (2013.01); *H01Q 1/2283* (2013.01)

(58) Field of Classification Search
CPC ..... H01Q 21/26; H01Q 2/2283
USPC ..... 343/798
See application file for complete search history.

(56) References Cited

U.S. PATENT DOCUMENTS

2007/0052611 A1* 3/2007 Lee ..... H01Q 9/26 343/700 MS
2016/0141765 A1* 5/2016 Moon ..... H01Q 21/293 343/812

* cited by examiner

*Primary Examiner* — Peguy Jean Pierre
(74) *Attorney, Agent, or Firm* — ScienBiziP, P.C.

(57) ABSTRACT

An antenna structure includes a substrate and a plurality of radiation units, each radiation unit comprising a first radiator and a second radiator. The first radiator is positioned on a first surface of the substrate and includes a first radiation portion and a feed point. The feed point is electrically connected to the first radiation portion for feed current and signals to a corresponding radiation unit. The second radiator is positioned at a second surface of the substrate and is symmetrical with the first radiator about the substrate. The second radiator includes a second radiation portion and a ground portion. The ground portion is electrically connected to the second radiation portion to provide grounding for the radiation unit. The antenna structure has a good radiation efficiency and good isolation between radiators to reduce cross-interference.

16 Claims, 16 Drawing Sheets

200

ANTENNA STRUCTURE AND WIRELESS COMMUNICATION DEVICE USING SAME

FIELD

The subject matter herein generally relates to wireless communications, to an antenna structure, and a wireless communication device using the antenna structure.

BACKGROUND

Multiple antennas improve transmission efficiencies and reliabilities of wireless communications. For example, a multiple input multiple output (MIMO) system transmits signals of different frequency bands through multiple antennas in its transmitter architecture, and receives signals of different frequency bands through multiple antennas of its receiver. However, signals transmitted or received by the multiple antennas can interfere with each other, and the multiple antennas may also occupy a large space.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
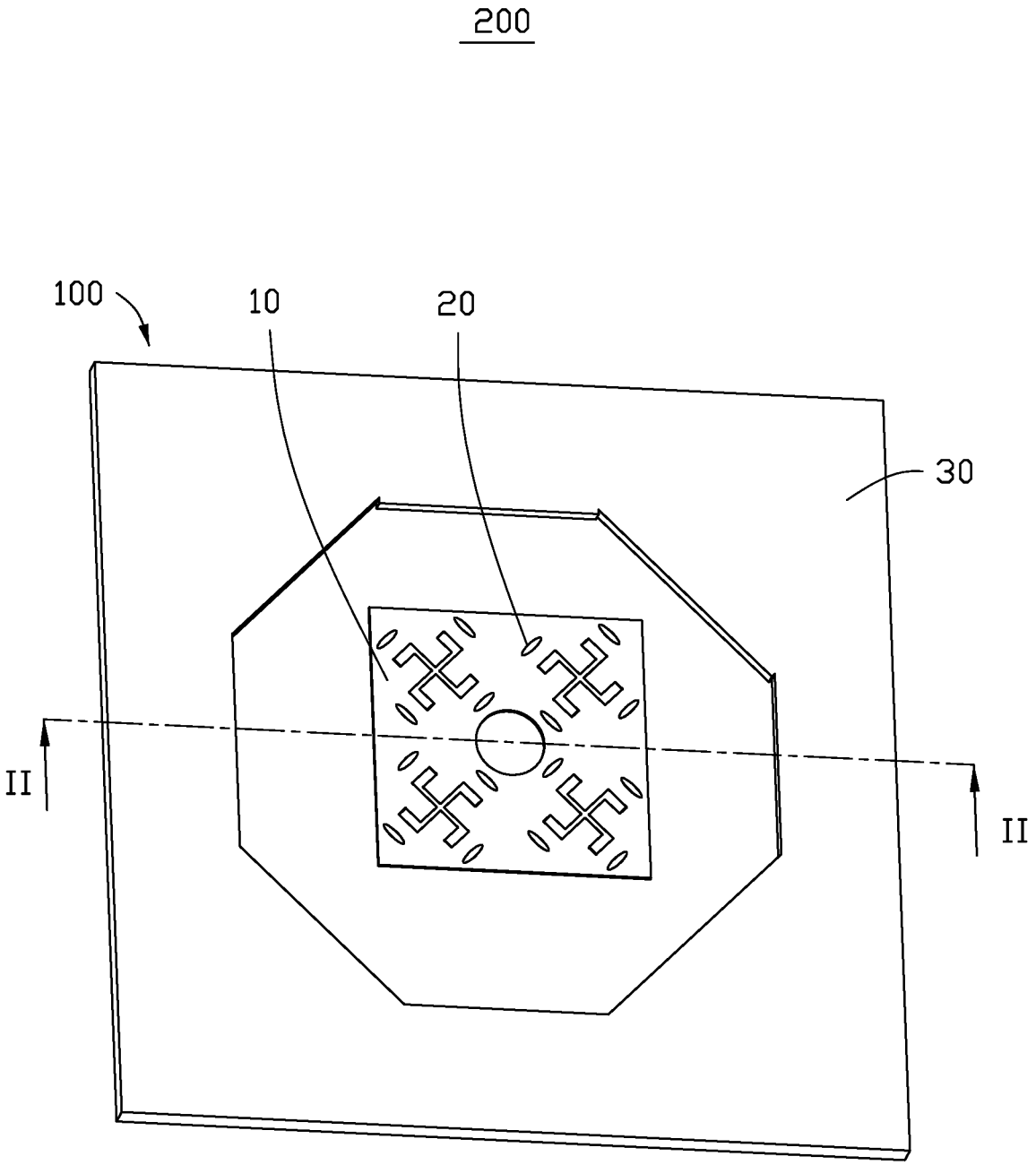
FIG. 1 is a schematic diagram of an embodiment of an antenna structure, applied to a wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and wireless communication device using same.

Figure 2:
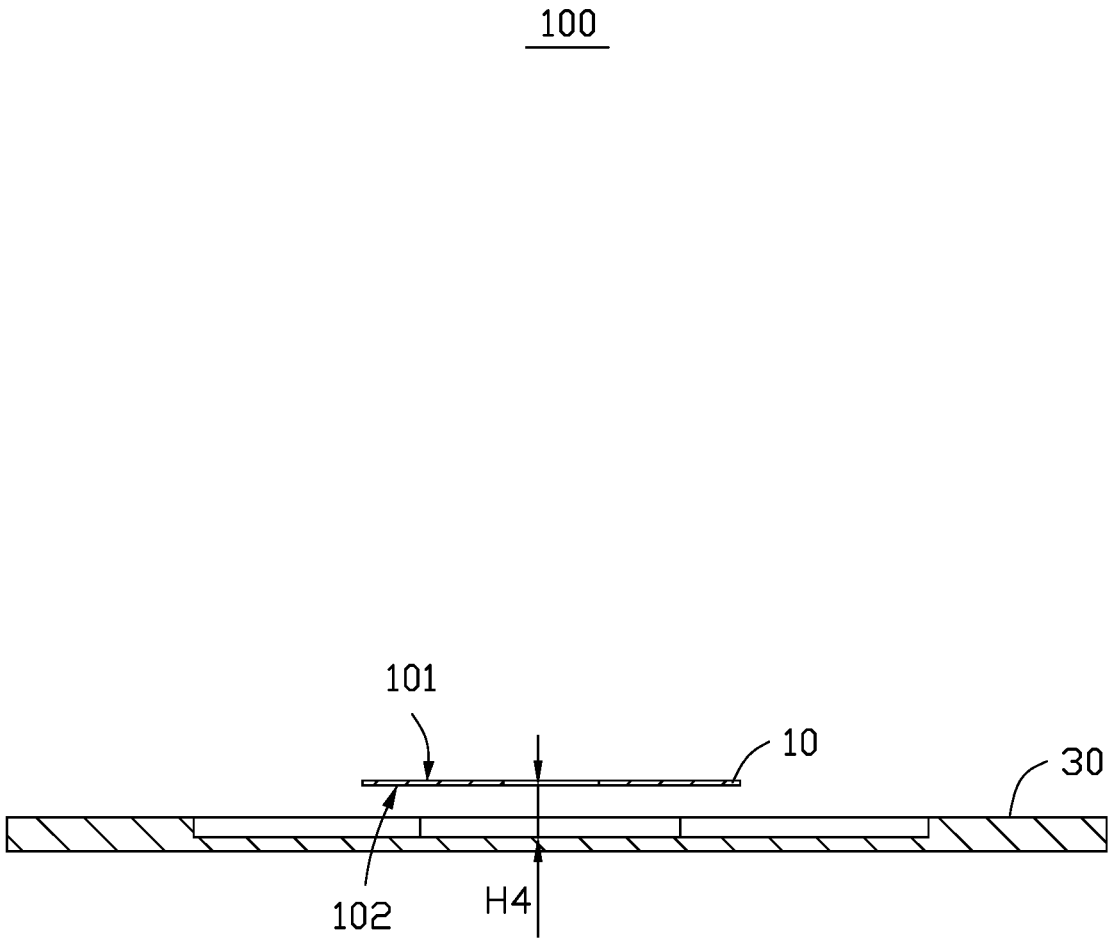
FIG. 2 is a cross-sectional view along line II-II of FIG. 1.

FIG. 1 and FIG. 2 illustrate an embodiment of a wireless communication device 200 using an antenna structure 100. The wireless communication device 200 can be, for example, a customer premise equipment (CPE), a router, or a set top box. The antenna structure 100 can transmit and receive radio waves.

The antenna structure 100 includes a substrate 10, a plurality of radiation units 20, and a reflection portion 30. The antenna structure 100 can be glued to a shell of the wireless communication device 200. The plurality of radiation units 20 is arranged on a surface of the substrate 10. The reflection portion 30 is spaced apart from the substrate 10.

The substrate 10 is a sheet of material. The substrate 10 includes a first surface 101 and a second surface 102. The substrate 10 may be a metal substrate, a ceramic substrate, or an organic substrate. In one embodiment, the substrate 10 is a sheet roughly square in shape. A material of the substrate 10 is a glass fiber (FR-4) board.

Figure 3:
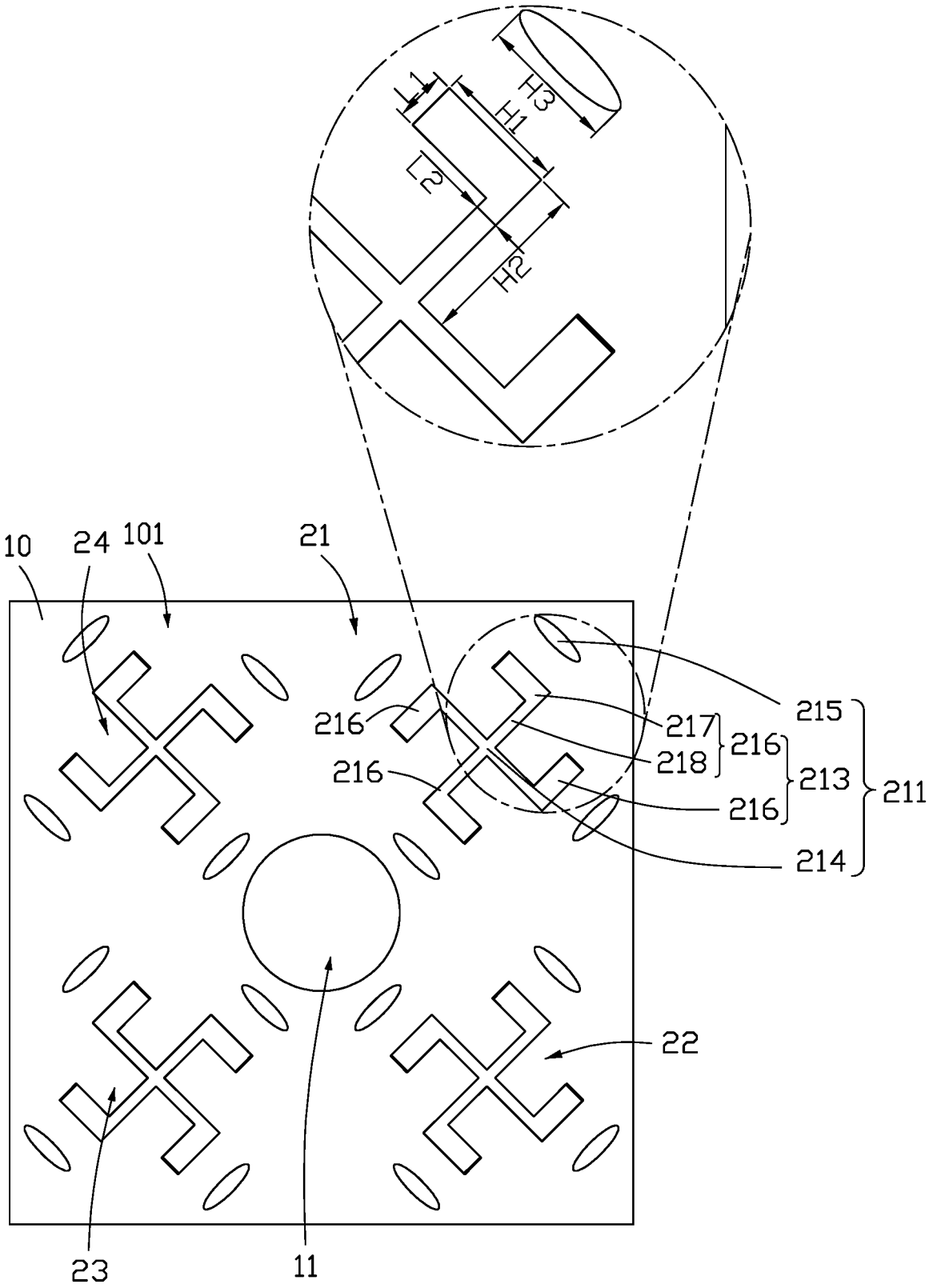
FIG. 3 is similar to FIG. 1, but shown from a first angle.

As illustrated in FIG. 3, in this embodiment, there are four radiation units 20. The four radiation units 20 are positioned at four corners of the substrate 10. In one embodiment, two radiation units 20 located in the same diagonal direction of the substrate 10 are symmetrical with respect to a center point of the substrate 10.

In this embodiment, the four radiation units 20 includes a first radiation unit 21, a second radiation unit 22, a third radiation unit 23, and a fourth radiation unit 24. Then, the antenna structure 100 forms a MIMO antenna. The first radiation unit 21 is positioned at an upper right corner of the substrate 10. The second radiation unit 22 is positioned at a lower right corner of the substrate 10. The third radiation unit 23 is positioned at a lower left corner of the substrate 10. The fourth radiation unit 23 is positioned at an upper left corner of the substrate 10. The first radiation unit 21 and the third radiation unit 23 are mutually symmetrical about the center point of the substrate 10 in a first diagonal direction of the substrate 10. The second radiation unit 22 and the fourth radiation unit 24 are mutually symmetrical about the center point of the dielectric substrate 10 in a second diagonal direction of the substrate 10.

In this embodiment, structure of the first radiation unit 21, the second radiation unit 22, the third radiation unit 23, and the fourth radiation unit 24 is the same. In this embodiment, taking the first radiation unit 21 as an example, the structure of each radiation unit 20 will be described below.

Figure 4:
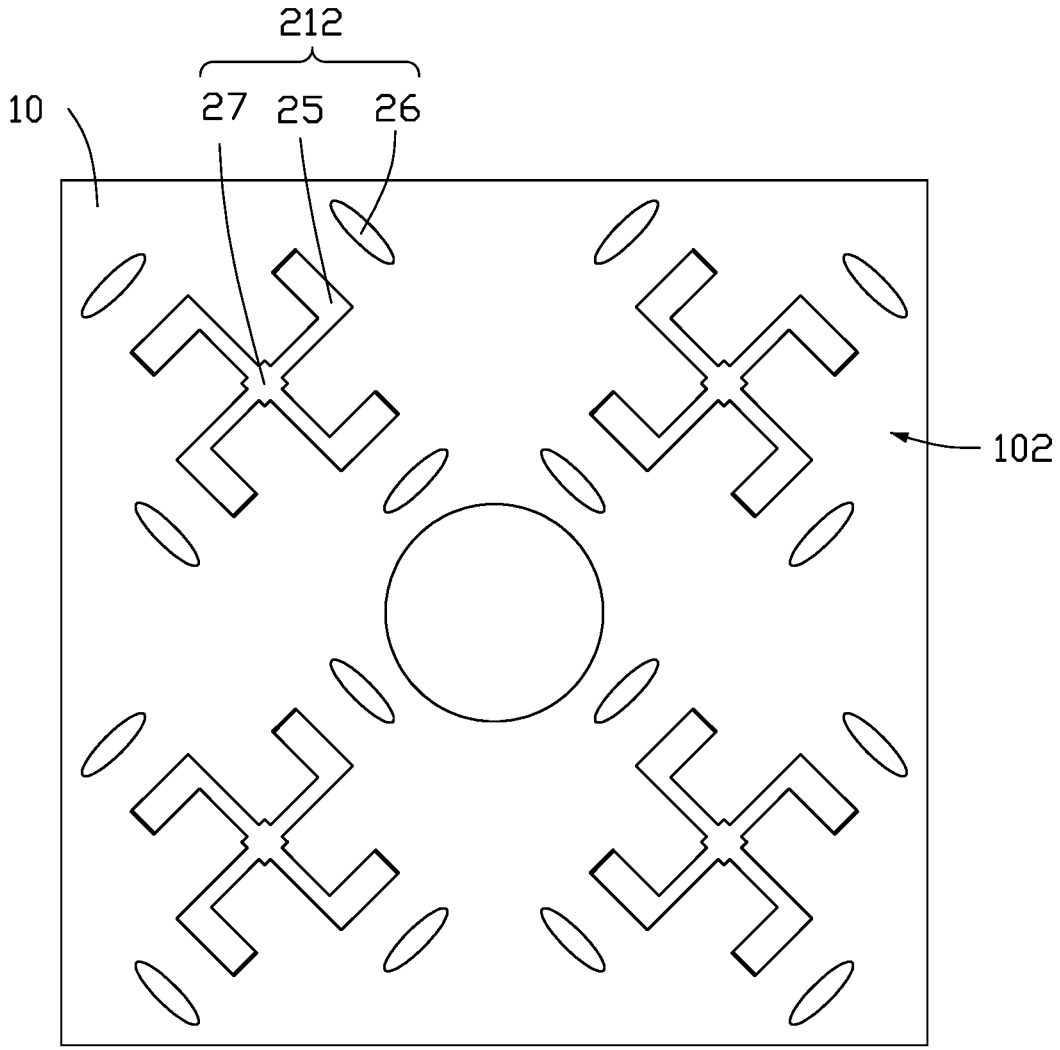
FIG. 4 is similar to FIG. 1, but shown from a second angle.

As illustrated in FIG. 3 and FIG. 4, the first radiation unit 21 includes a first radiator 211 and a second radiator 212. The first radiator 211 is positioned on the first surface 101 of the substrate 10. The second radiator 212 is positioned on the second surface 102 of the substrate 10. The first radiator 211 is symmetrical with the second radiator 212 with respect to the substrate 10.

The first radiator 211 includes a first radiation portion 213, a feed portion 214, and a plurality of first isolation portions 215.

In this embodiment, the first radiation unit 213 includes four resonance arms 216. Each of the resonant arms 216 includes a first resonance section 217 and a second resonance section 218. One end of the second resonance section 218 is vertically connected to one end of the first resonance section 217. In this way, the resonance arm 216 is approximately the shape of an inverted L. Other ends of each second resonance section 218 away from the first resonance section 217 are connected with each other. Each of the second resonance sections 218 is perpendicular to the other two adjacent second resonance sections 218. Further, two second resonance sections 218 of the first radiation unit 213 are positioned in a diagonal direction of the substrate 10. Thus, the four second resonance sections 218 are connected with each other and appear approximately in a form of an X. One end of each of the first resonance sections 217 away from the end of the second resonance section 218 faces the same side in a counterclockwise direction or a clockwise direction. Thus, any one of the four resonance arms 216 can be rotated 90 degrees, either all in the counterclockwise direction or all in the clockwise direction, to obtain the adjacent resonance arm 216, that is, the first radiation portion 213 is roughly in the form of a left-facing sauwastika ("卐").

In one embodiment, a length H1 of the first resonance section 217 is less than a length H2 of the second resonance section 218. A width L1 of the first resonance section 217 is greater than a width L2 of the second resonance section 218. For example, in one embodiment, the length of the first resonance section 217 is about 7.5 mm. The width of the first resonance section 217 is about 3 mm. The length of the second resonance section 218 is about 10 mm. The width of the second resonance section 218 is 1.5 mm.

The feed point 214 is electrically connected to the first radiation unit 213 for feeding current and signals to the first radiation unit 213. In detail, the feed point 214 is positioned at a center of the first radiation portion 213, that is, a junction of the four second resonance sections 218. The feed point 214 can be electrically connected to a feed source through a feed line (not shown) to feed current and signals to the first radiation unit 21.

In this embodiment, the first radiator 211 includes four first isolation units 215. The first isolation units 215 are spaced apart from the first radiation unit 213. The first isolation units 215 are positioned around a periphery of the first radiation unit 213 to improve the isolation of the antenna structure 100. Each of the four first isolation units 215 is approximately elliptical in shape. A length H3 of the first isolation portion 215 is approximately equal to the length H1 of the first resonance section 217. The four first isolation portions 215 are positioned at the side of the first resonance section 217 away from the second resonance section 218, and are parallel to the first resonance section 217.

As illustrated in FIG. 4, the second radiator 212 is positioned at the second surface 102 of the substrate 10 and corresponds to the first radiator 211. The second radiator 212 is symmetrical with the first radiator 211 about the substrate 10. In this embodiment, the second radiator 212 includes a second radiation portion 25, a second isolation portion 26, and a grounding portion 27. A structure of the second radiation portion 25 is the same as that of the first radiation portion 213. A structure of the second isolation portion 26 is the same as that of the first isolation portion 215. The second isolation portion 26 is spaced from the second radiation portion 25 and located around the periphery of the second radiation portion 25 to improve isolation of the antenna structure 100. In this embodiment, a difference between the second radiator 212 and the first radiator 211 is that the second radiator 212 includes the ground portion 27. The ground portion 27 is a sheet of material approximately square in shape. The ground portion 27 is electrically connected to the second radiation portion 25. The ground portion 27 is electrically connected to a ground point of the circuit board to provide grounding for the first radiation unit 21.

In one embodiment, the first radiator 211 can be obtained by laying metal materials on the first surface 101 of the substrate 10. The second radiator 212 can be obtained by laying metal materials on the second surface 102 of the dielectric substrate 10. For example, the first surface 101 and the second surface 102 of the substrate 10 can both be coated with copper to obtain the first radiator 211 and the second radiator 212.

In this embodiment, the substrate 10 can define a via (not shown) corresponding to the feed point 214 and the ground portion 27. The feed point 214 can be electrically connected with the ground portion 27 through the via.

As described above, structures of the second radiation unit 22, the third radiation unit 23, and the fourth radiation unit 24 are the same or similar to that of the first radiation unit 21. For example, they can be obtained by movement, rotation, or symmetrical mapping of the first radiation unit 21. That is to say, the second radiation unit 22, the third radiation unit 23, and the fourth radiation unit 24 also include the first and second radiators as previously described.

In this embodiment, the reflection unit 30 is spaced in parallel with the substrate 10. In one embodiment, the reflection unit 30 is made of metal material and is substantially rectangular. The reflection unit 30 is spaced apart from the second surface 102 of the substrate 10. In one embodiment, a distance H4 between the reflection unit 30 and the substrate 10 is greater than or equal to 11 mm.

In this embodiment, the substrate 10 and the reflection unit 30 can be connected through a connecting member (not shown). For example, in one embodiment, the substrate 10 defines a through hole 11 (see FIG. 3). One end of the connecting member is inserted into the through hole 11, and the other end is fixedly connected with the substrate 10. In one embodiment, the connecting member can be made of an insulating material, such as plastic material.

When current is fed into the feed point 214 of each of the first radiators 211, the current flows through the first radiation portion 213, then flows through the radiation portion of the second radiator 212 through the ground portion 27, being grounded through the ground portion 27. Thereby, a working mode and radiated signal in a working frequency band are excited.

In this embodiment, the working mode includes a WIFI 5 GHz working mode, a WIFI 6 GHz working mode, a sub-6G working mode, and a 7.1-7.25 GHz working mode. The working frequency bands include 5.15-5.85 GHz, 6.1-6.8 GHz, and 7.1-7.25 GHz broadcasting frequencies.

When the antenna structure 100 works in the working frequency band, a standing wave ratio is less than 2.5 dB, and a radiation efficiency can reach 80%. That is, the antenna structure 100 has better radiation efficiency.

Figure 5:
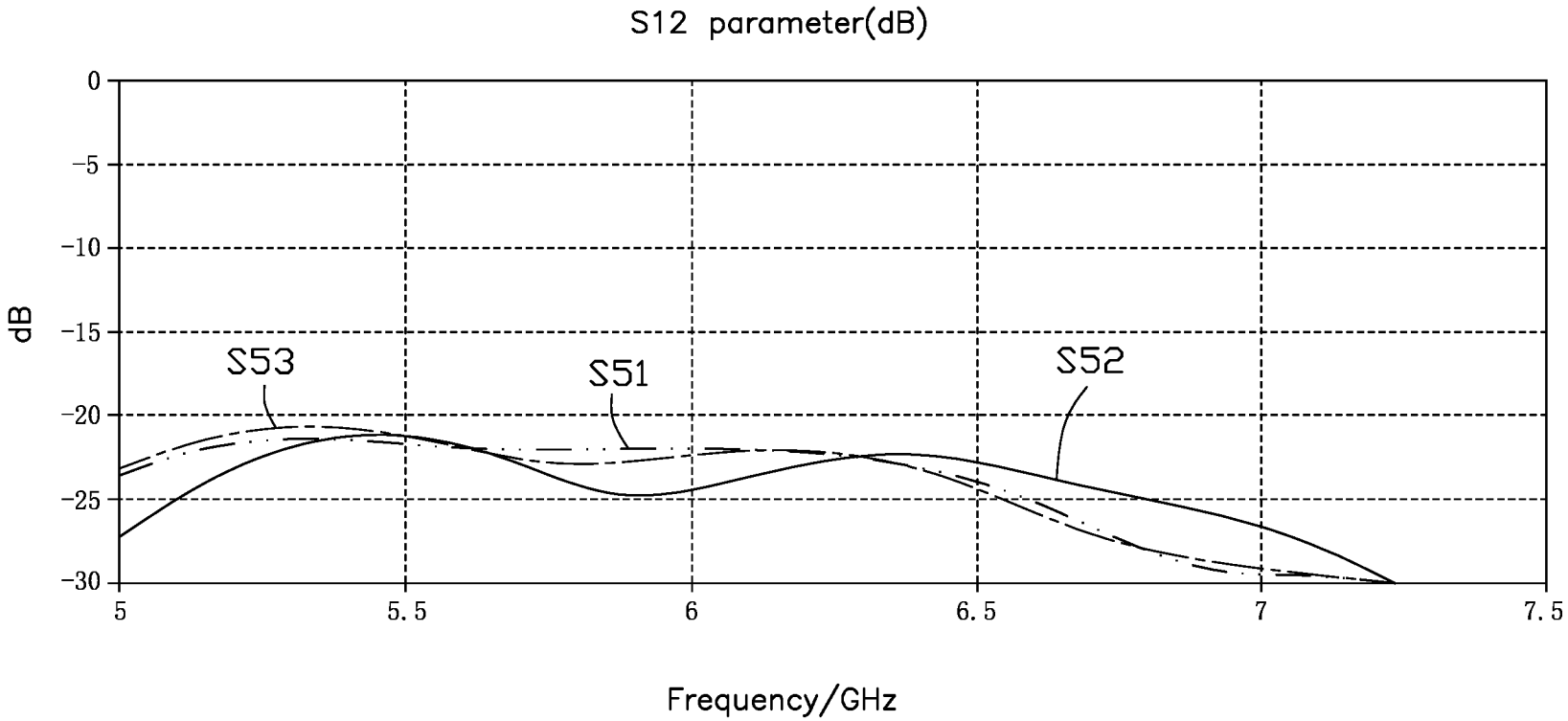
FIG. 5 is an S12 parameter (isolation) graph of a first radiation unit and other three radiation units of the antenna structure of FIG. 1, when working in a frequency band of 5.15 GHz-7.25 GHz.

As illustrated in FIG. 5 to FIG. 8, FIG. 5 is an S12 parameter (isolation) curve when the first radiation unit 21 and the other three radiation units of the antenna structure 100 of the present disclosure are working from 5.15 ghz to 7.25 ghz respectively FIG. 5 is an S12 parameter (isolation) graph of the first radiation unit 21 and the other three radiation units of the antenna structure of FIG. 1, when the antenna structure 100 works in a frequency band of 5.15 GHz-7.25 GHz. For example, a curve S51 is an S12 value between the first radiation unit 21 and the second radiation unit 22 when the antenna structure 100 works in the frequency band of 5.15 GHz-7.25 GHz. A curve S52 is an S12 value between the first radiation unit 21 and the third radiation unit 23 when the antenna structure 100 works in the frequency band of 5.15 GHz-7.25 GHz. A curve S53 is an S12 value between the first radiation unit 21 and the fourth radiation unit 24 when the antenna structure 100 works in the frequency band of 5.15 GHz-7.25 GHz.

Figure 6:
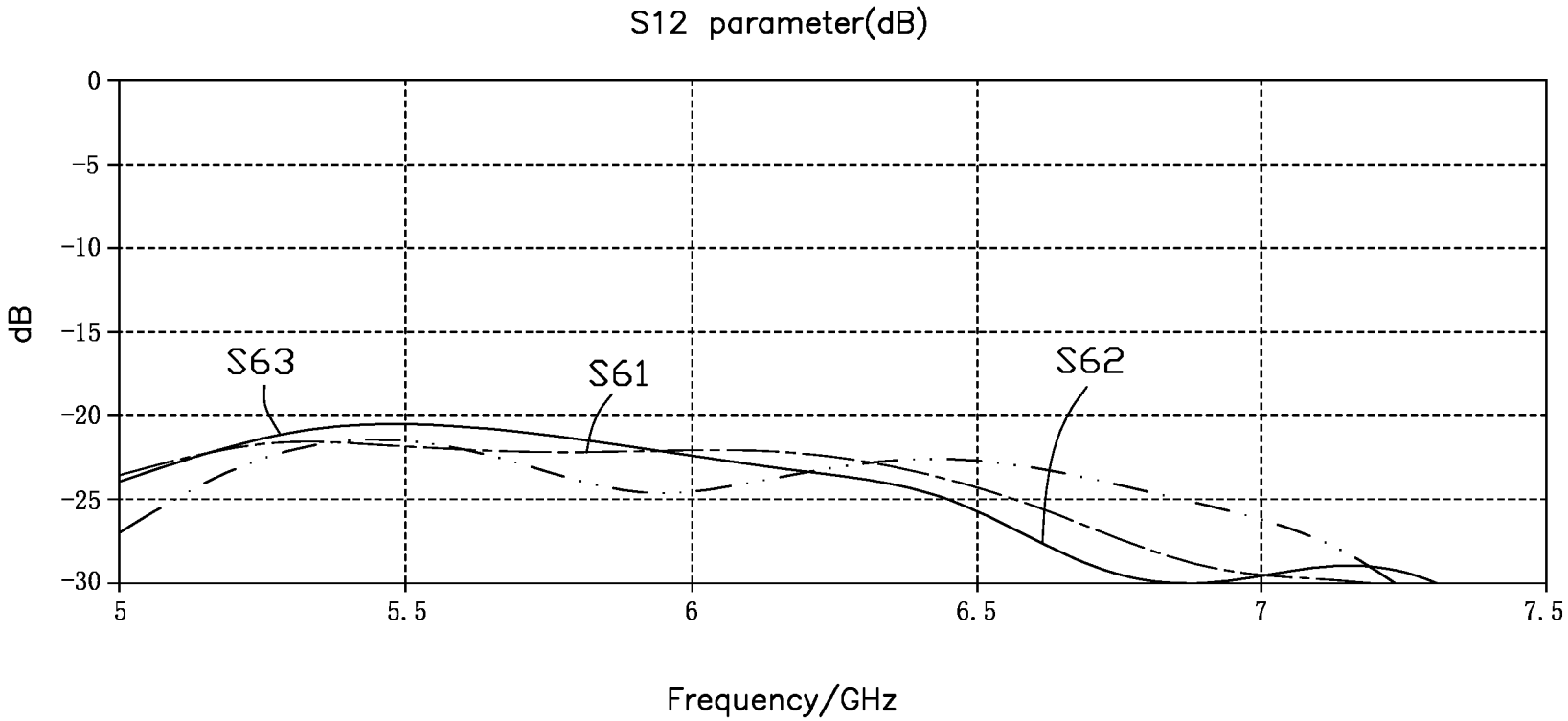
FIG. 6 is an S12 parameter (isolation) graph of a second radiation unit and other three radiation units of the antenna structure of FIG. 1, when working in a frequency band of 5.15 GHz-7.25 GHz.

FIG. 6 is an S12 parameter (isolation) graph of the second radiation unit 22 and the other three radiation units of the antenna structure of FIG. 1, when the antenna structure 100 works in a frequency band of 5.15 GHz-7.25 GHz. For example, a curve S61 is an S12 value between the second radiation unit 22 and the first radiation unit 21 when the antenna structure 100 works in the frequency band of 5.15 GHz-7.25 GHz. A curve S62 is an S12 value between the second radiation unit 22 and the third radiation unit 23 when the antenna structure 100 works in the frequency band of 5.15 GHz-7.25 GHz. A curve S63 is an S12 value between the second radiation unit 22 and the fourth radiation unit 24 when the antenna structure 100 works in the frequency band of 5.15 GHz-7.25 GHz.

Figure 7:
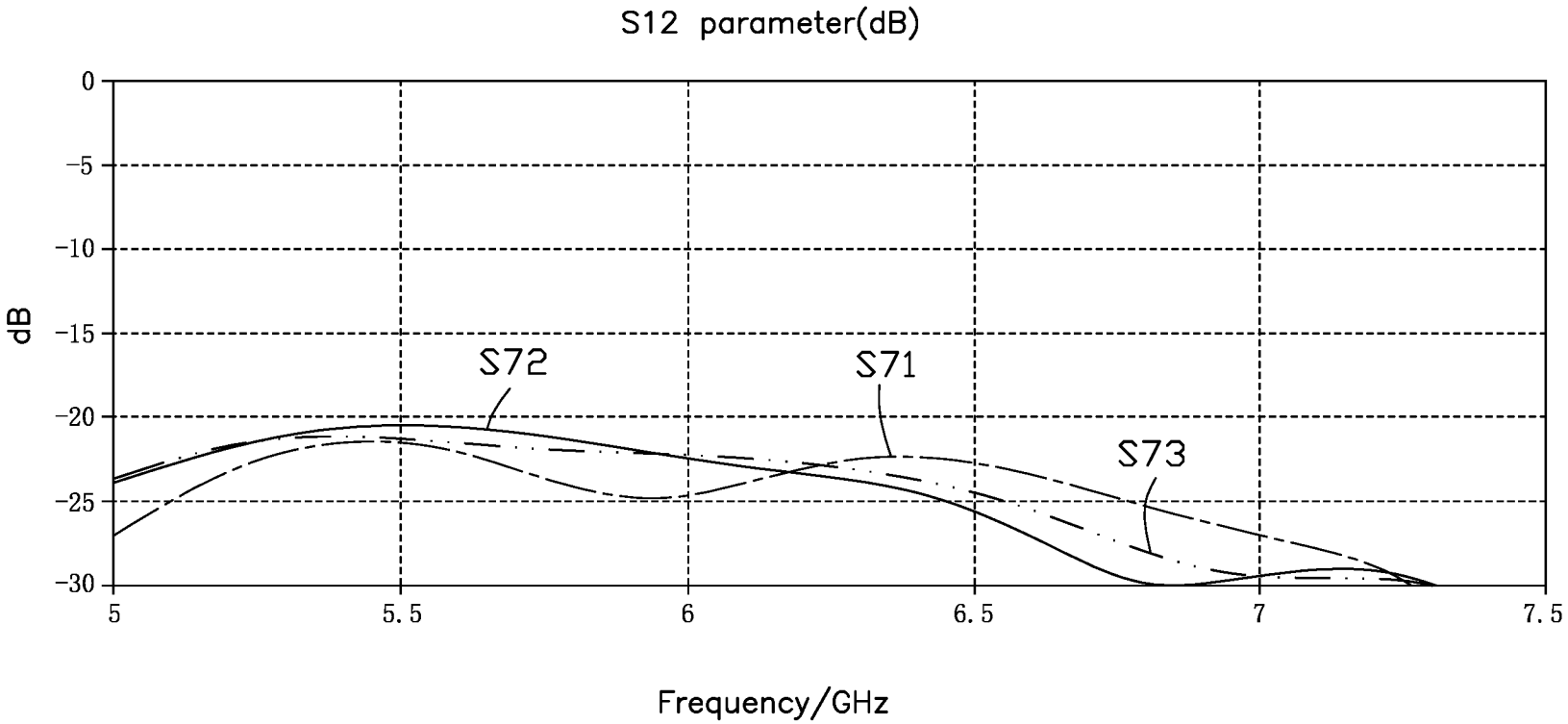
FIG. 7 is an S12 parameter (isolation) graph of a third radiation unit and other three radiation units of the antenna structure of FIG. 1, when working in a frequency band of 5.15 GHz-7.25 GHz.

FIG. 7 is a S12 parameter (isolation) graph of the third radiation unit 23 and the other three radiation units of the antenna structure of FIG. 1, when the antenna structure 100 works in a frequency band of 5.15 GHz-7.25 GHz. For example, a curve S71 is an S12 value between the third radiation unit 23 and the first radiation unit 21 when the antenna structure 100 works in the frequency band of 5.15 GHz-7.25 GHz. A curve S72 is an S12 value between the third radiation unit 23 and the second radiation unit 22 when the antenna structure 100 works in the frequency band of 5.15 GHz-7.25 GHz. A curve S73 is an S12 value between the third radiation unit 23 and the fourth radiation unit 24 when the antenna structure 100 works in the frequency band of 5.15 GHz-7.25 GHz.

Figure 8:
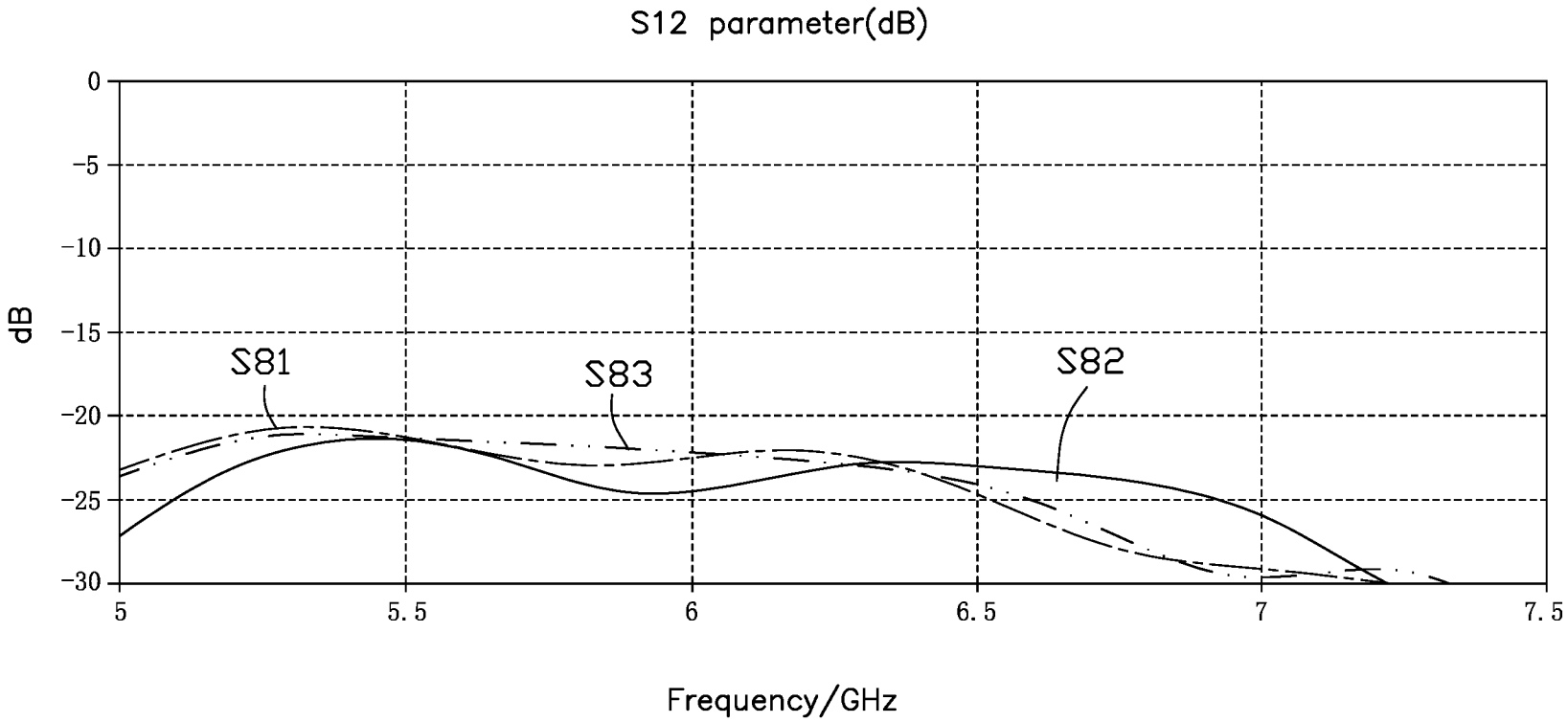
FIG. 8 is an S12 parameter (isolation) graph of a fourth radiation unit and other three radiation units of the antenna structure of FIG. 1, when working in a frequency band of 5.15 GHz-7.25 GHz.
Figure 9:
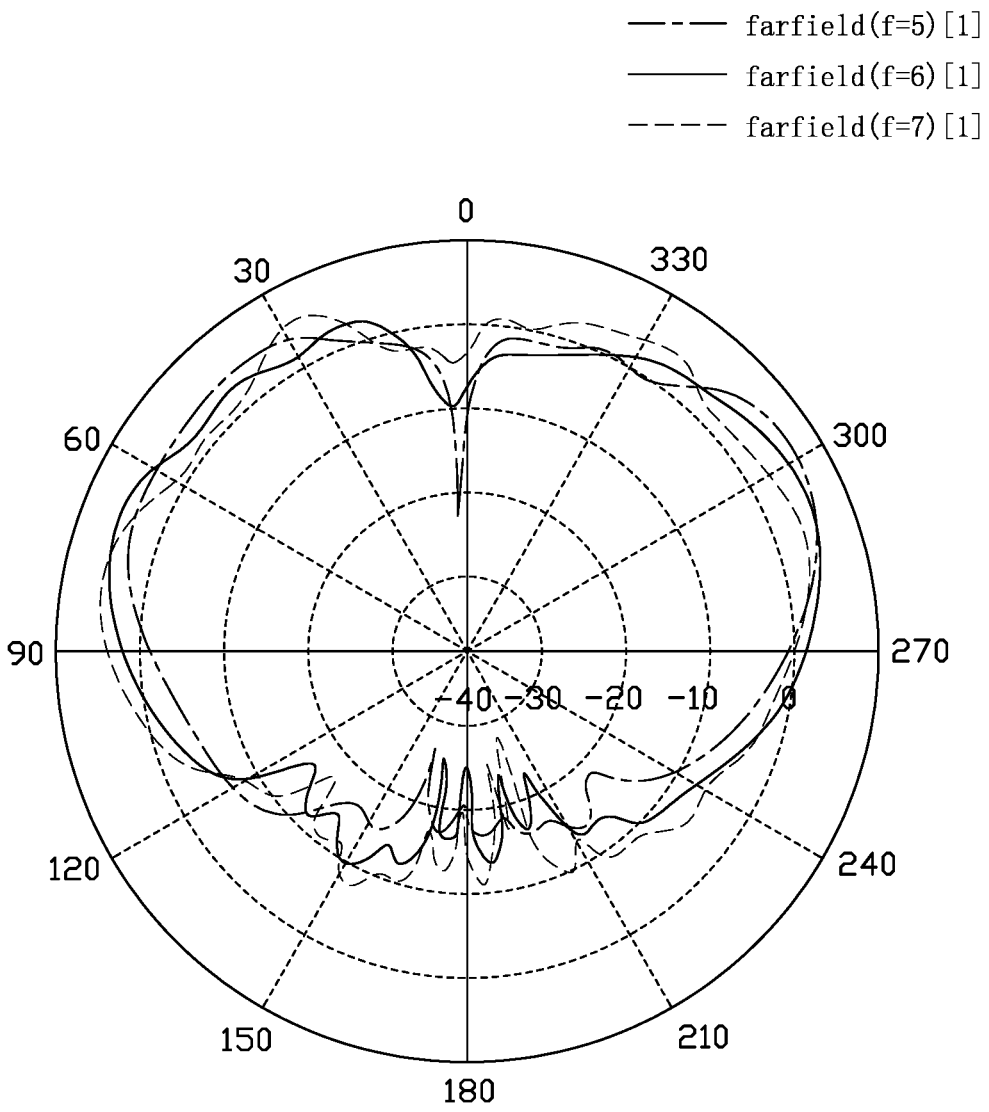
FIG. 9 is a symmetrical radiation field pattern diagram of the antenna structure of FIG. 1, resonance frequencies of the first radiation unit being 5 GHz, 6 GHz, and 7 GHz, respectively.

FIG. 8 is an S12 parameter (isolation) graph of the fourth radiation unit 23 and the other three radiation units of the antenna structure of FIG. 1, when the antenna structure 100 works in a frequency band of 5.15 GHz-7.25 GHz. For example, a curve S81 is an S12 value between the fourth radiation unit 24 and the first radiation unit 21 when the antenna structure 100 works in the frequency band of 5.15 GHz-7.25 GHz. A curve S82 is an S12 value between the fourth radiation unit 24 and the second radiation unit 22 when the antenna structure 100 works in the frequency band of 5.15 GHz-7.25 GHz. A curve S83 is an S12 value between the fourth radiation unit 24 and the third radiation unit 23 when the antenna structure 100 works in the frequency band of 5.15 GHz-7.25 GHz.

As shown in FIG. 5 to FIG. 8, each radiation unit of the antenna structure 100 can work in the above frequency bands of 5.15-5.85 GHz, 6.1-6.8 GHz, and 7.1-7.25 GHz, and isolation between each two radiation units is less than −20 dB, a high degree of isolation.

Figure 10:
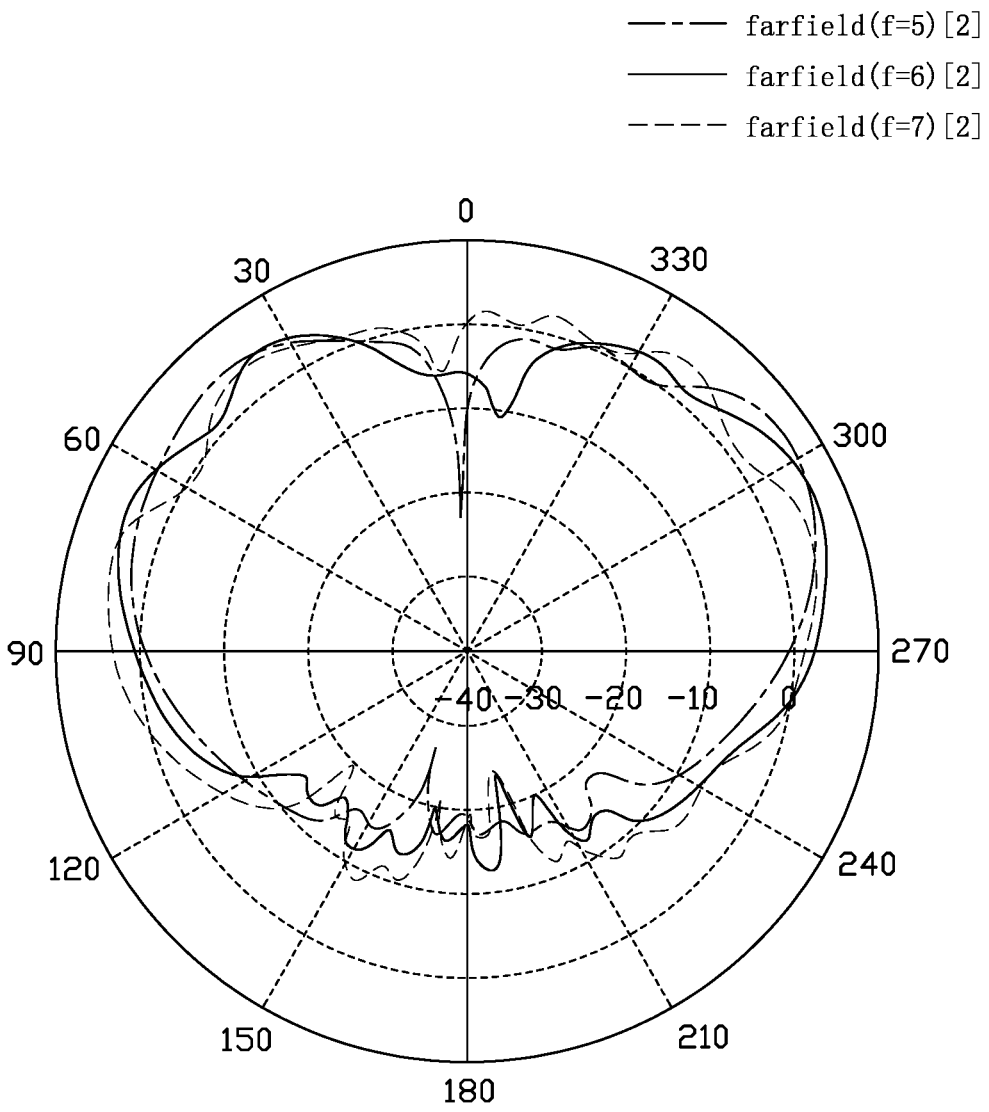
FIG. 10 is a symmetrical radiation field pattern diagram of the antenna structure of FIG. 1, resonance frequencies of the second radiation unit being 5 GHz, 6 GHz, and 7 GHz, respectively.
Figure 11:
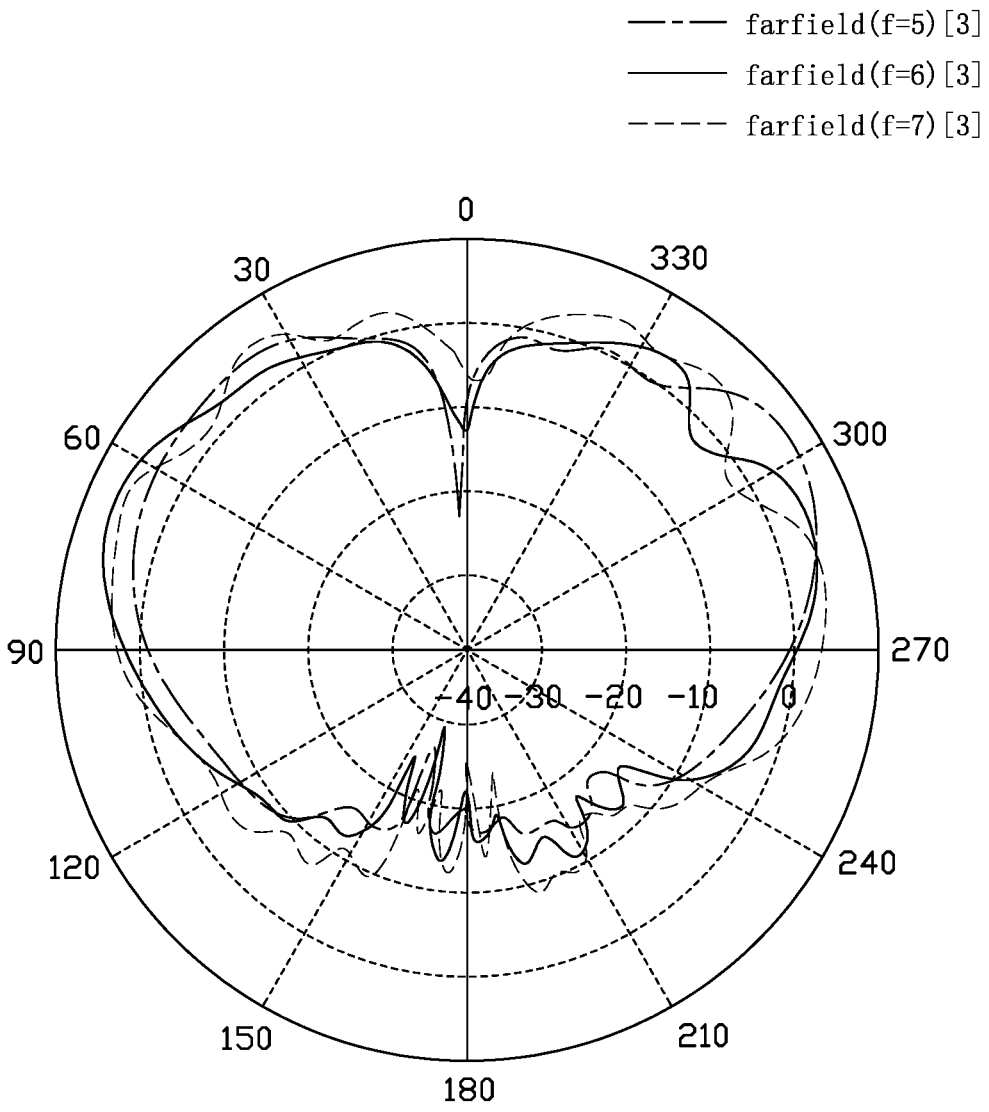
FIG. 11 is a symmetrical radiation field pattern diagram of the antenna structure of FIG. 1, resonance frequencies of the third radiation unit being 5 GHz, 6 GHz, and 7 GHz, respectively.
Figure 12:
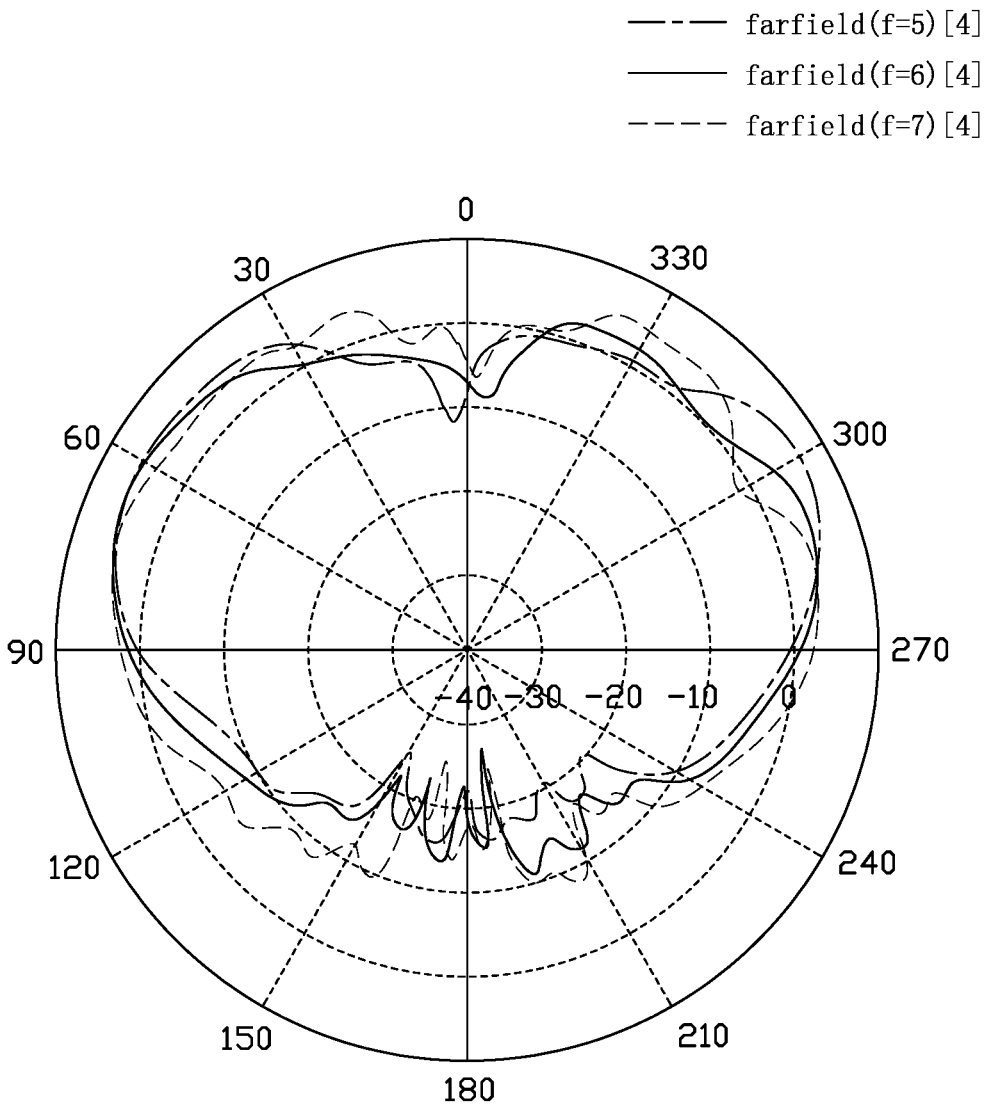
FIG. 12 is a symmetrical radiation field pattern diagram of the antenna structure of FIG. 1, resonance frequencies of the fourth radiation unit being 5 GHz, 6 GHz, and 7 GHz, respectively.

As illustrated in FIG. 9 to FIG. 16, FIG. 9 is a symmetrical radiation field pattern diagram of the antenna structure of FIG. 1, when resonance frequencies of the first radiation unit are 5 GHz, 6 GHz, and 7 GHz respectively. FIG. 10 is a symmetrical radiation field pattern diagram of the antenna structure of FIG. 1, when resonance frequencies of the second radiation unit are 5 GHz, 6 GHz, and 7 GHz respectively. FIG. 11 is a symmetrical radiation field pattern diagram of the antenna structure of FIG. 1, when resonance frequencies of the third radiation unit are 5 GHz, 6 GHz, and 7 GHz respectively. FIG. 12 is a symmetrical radiation field pattern diagram of the antenna structure of FIG. 1, when resonance frequencies of the fourth radiation unit are 5 GHz, 6 GHz, and 7 GHz respectively.

Figure 13:
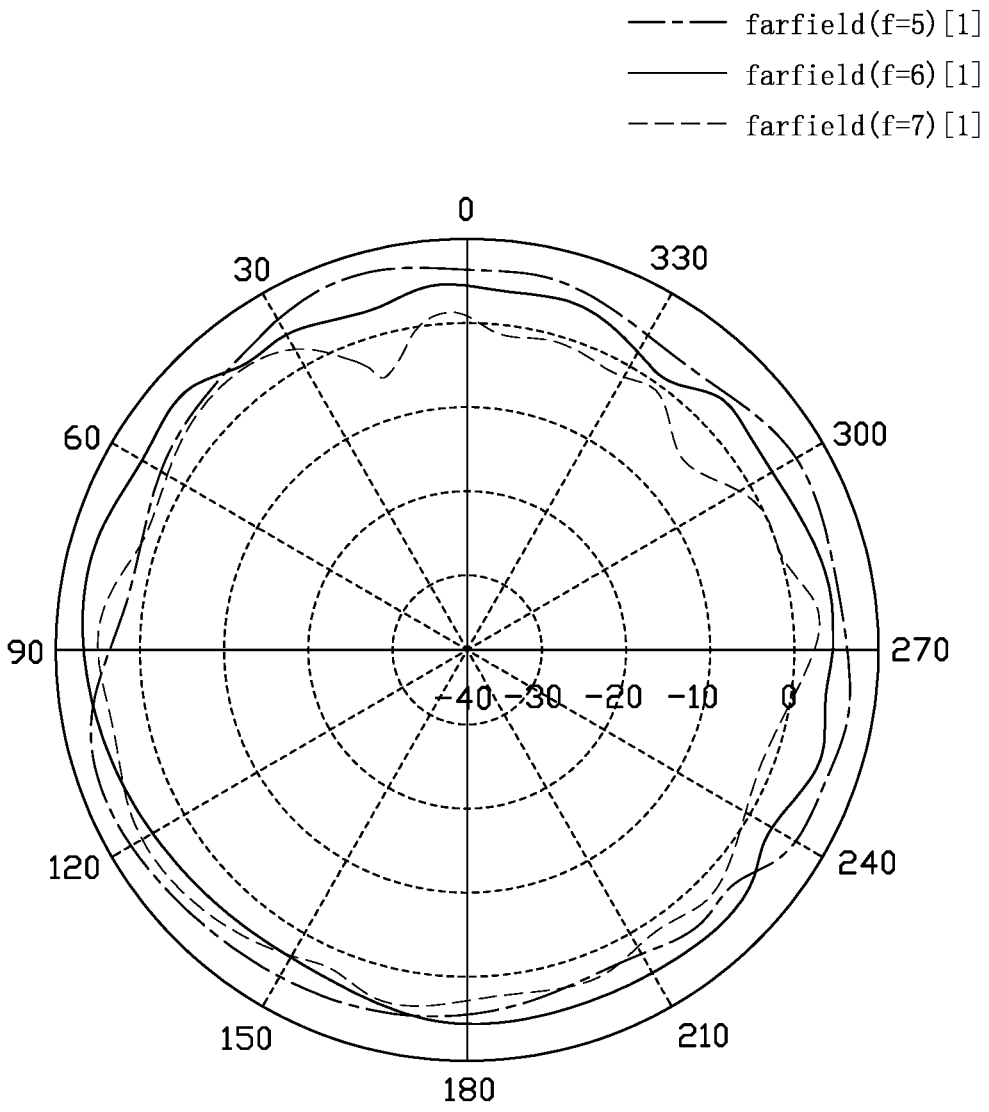
FIG. 13 is an omnidirectional radiation field pattern diagram of the antenna structure of FIG. 1, resonance frequencies of the first radiation unit being 5 GHz, 6 GHz, and 7 GHz, respectively.
Figure 14:
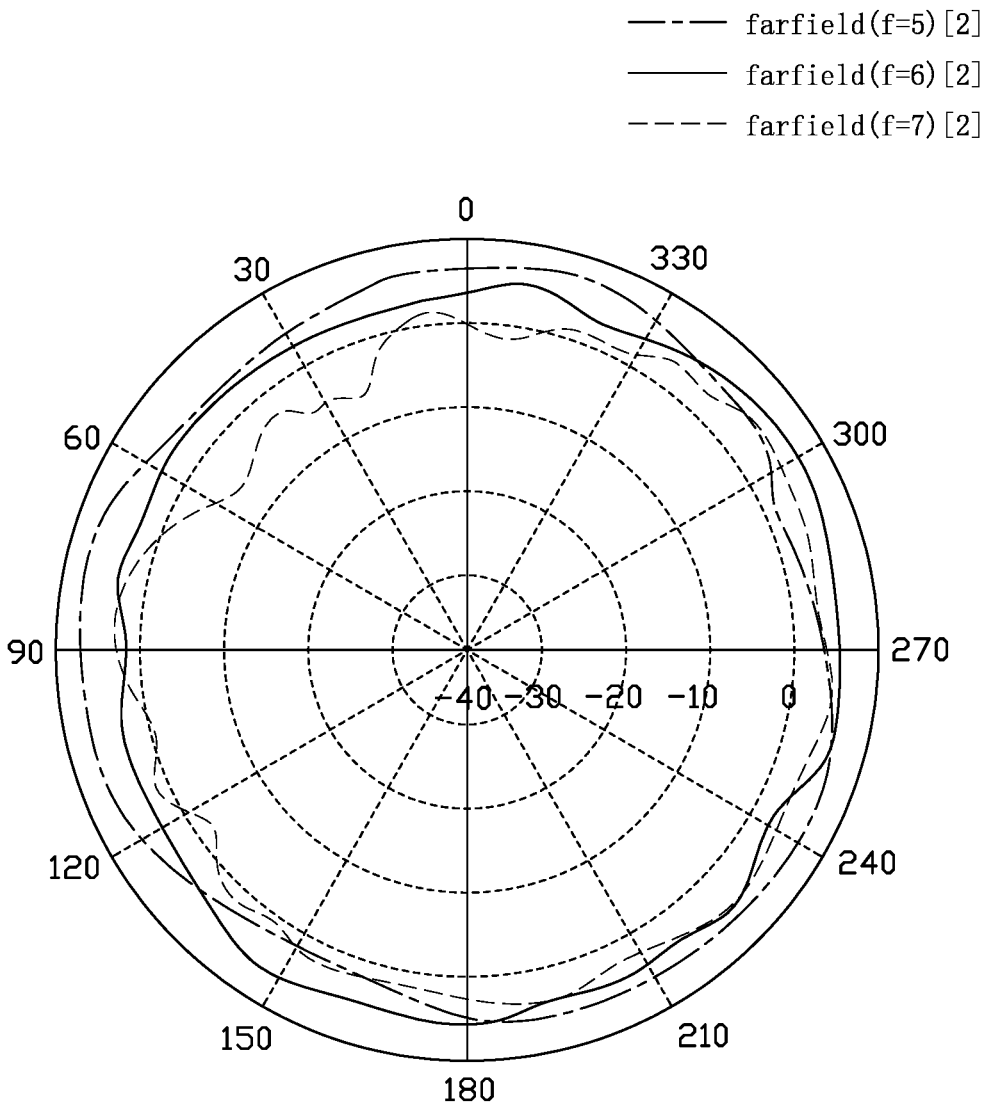
FIG. 14 is an omnidirectional radiation field pattern diagram of the antenna structure of FIG. 1, resonance frequencies of the second radiation unit being 5 GHz, 6 GHz, and 7 GHz, respectively.
Figure 15:
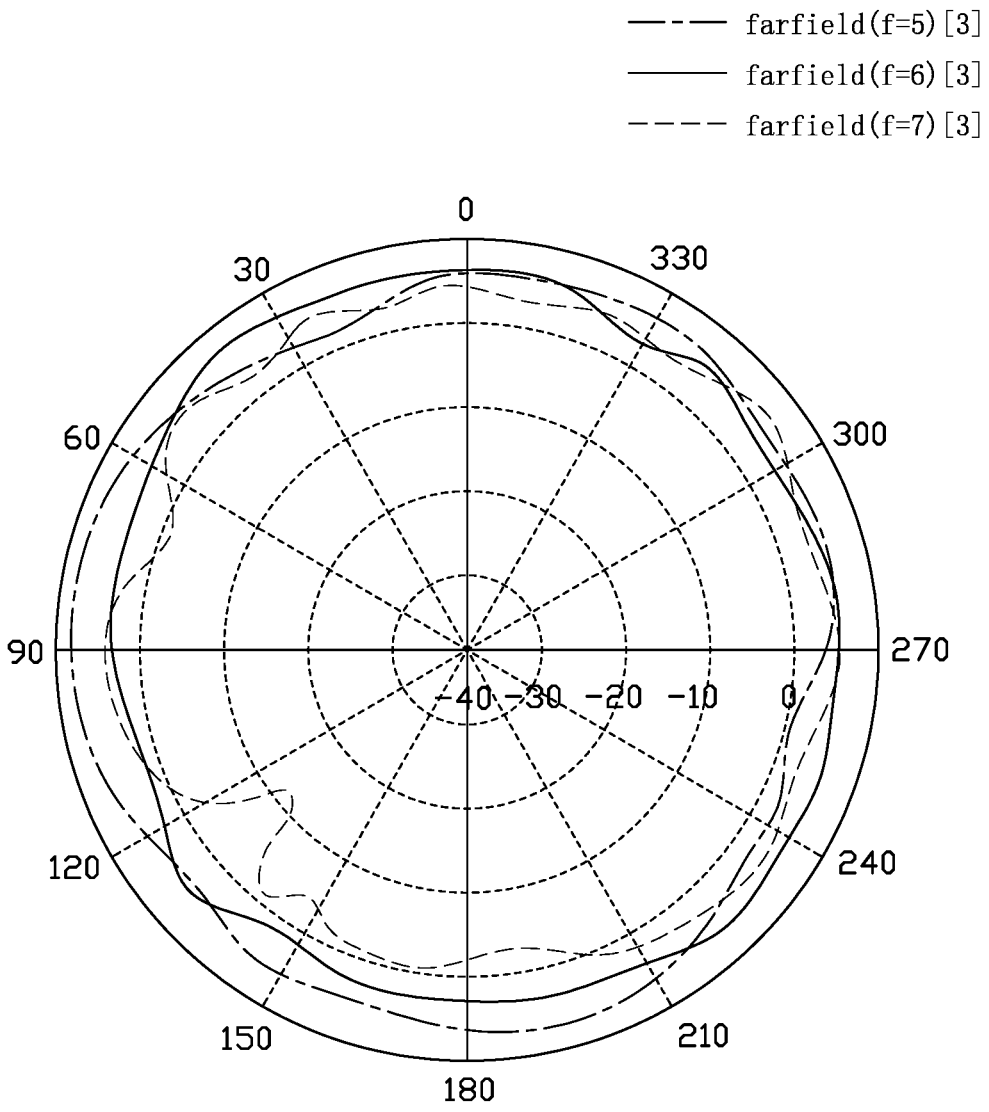
FIG. 15 is an omnidirectional radiation field pattern diagram of the antenna structure of FIG. 1, resonance frequencies of the third radiation unit being 5 GHz, 6 GHz, and 7 GHz, respectively.
Figure 16:
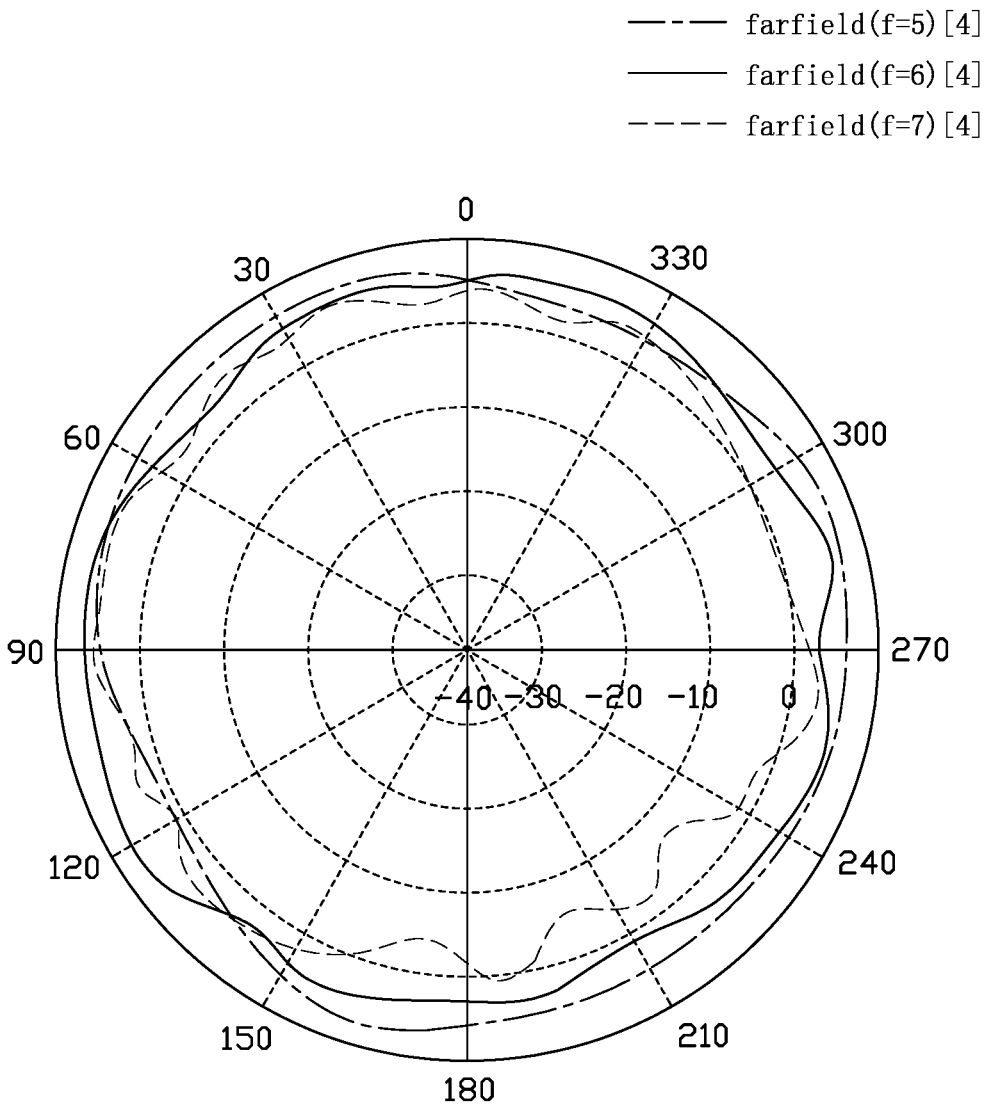
FIG. 16 is an omnidirectional radiation field pattern diagram of the antenna structure of FIG. 1, resonance frequencies of the fourth radiation unit being 5 GHz, 6 GHz, and 7 GHz, respectively.

FIG. 13 is an omnidirectional radiation field pattern diagram of the antenna structure of FIG. 1, when resonance frequencies of the first radiation unit are 5 GHz, 6 GHz, and 7 GHz respectively. FIG. 14 is an omnidirectional radiation field pattern diagram of the antenna structure of FIG. 1, when resonance frequencies of the second radiation unit are 5 GHz, 6 GHz, and 7 GHz respectively. FIG. 15 is an omnidirectional radiation field pattern diagram of the antenna structure of FIG. 1, when resonance frequencies of the third radiation unit are 5 GHz, 6 GHz, and 7 GHz respectively. FIG. 16 is an omnidirectional radiation field pattern diagram of the antenna structure of FIG. 1, when resonance frequencies of the fourth radiation unit are 5 GHz, 6 GHz, and 7 GHz respectively.

As shown in FIG. 9 to FIG. 16, when the resonance frequencies of the antenna structure 100 are 5 GHz, 6 GHz, and 7 GHz, the radiation units of the antenna structure 100 are symmetrical and are horizontally omnidirectional.

By setting the first radiator 211 and the second radiator 212 on the substrate 10, the antenna structure 100 effectively expands the bandwidth without increasing a volume or overall size of the antenna structure 100. The first radiator 211 and the second radiator 212 are symmetrical about the substrate 10, not only effectively extending the bandwidth of the antenna structure 100, but also giving good omnidirectionality and symmetry to the antenna structure 100. Furthermore, the first radiator 211 and the second radiator 212 both include the first isolation portion 215 and the second isolation portion 26 to improve isolation within the antenna structure 100.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure, comprising:

a substrate comprising a first surface and a second surface, the second surface being opposite to the first surface;

a plurality of radiation units, each of the radiation units comprising a first radiator and a second radiator; and a reflection portion;

wherein the first radiator is positioned on the first surface and comprises a first radiation portion and a feed point, the feed point is electrically connected to the first radiation portion to feed electrical currents and signals to a corresponding one of the radiation units, wherein the second radiator is positioned at the second surface and is symmetrical with the first radiator about the substrate, the second radiator comprises a second radiation portion and a ground portion, the ground portion is electrically connected to the second radiation portion to provide grounding for the radiation unit; and wherein the reflection portion is made of metal material and is positioned spaced apart from the second surface.

2. The antenna structure of claim 1, wherein the first radiator further comprises a plurality of first isolation portions, the second radiator comprises a plurality of second isolation portions, the plurality of first isolation portions is spaced from the first radiation portion and is positioned around a periphery of the first radiation portion, and wherein the plurality of second isolation portions is spaced from the second radiation portion and is positioned around a periphery of the second radiation portion.

3. The antenna structure of claim 2, wherein the first radiation portion comprises four resonance arms, each of the resonance arms comprises a first resonance section and a second resonance section, one end of the second resonance section is vertically connected to one end of the first resonance section, other ends of each second resonance section away from the first resonance section are connected with each other, and wherein the feed point is positioned at a junction of the second resonance sections.

4. The antenna structure of claim 3, wherein each of the second resonance sections is perpendicular to the other two adjacent second resonance sections, two second resonance sections of the first radiation unit are positioned in a diagonal direction of the substrate, one end of each of the first resonance sections away from the end of the second resonance section faces the same side in a counterclockwise direction or a clockwise direction.

5. The antenna structure of claim 3, wherein a number of the plurality of isolation portions is four, each of the plurality of isolation portions is positioned at the side of the first resonance section away from the second resonance section to parallel to the first resonance section.

6. The antenna structure of claim 5, wherein a length of the first resonance section is less than a length of the second resonance section, a width of the first resonance section is greater than a width of the second resonance section, a length of the first isolation portion is approximately equal to the length of the first resonance section.

7. The antenna structure of claim 3, wherein a structure of the second radiation portion is the same as that of the first radiation portion.

8. The antenna structure of claim 1, wherein a number of the plurality of radiation units is four, the four radiation units are positioned at four corners of the substrate, two radiation units located in the same diagonal direction of the substrate are symmetrical with respect to a center point of the substrate.

9. A wireless communication device, comprising:

an antenna structure comprising:

a substrate comprising a first surface and a second surface, the second surface being opposite to the first surface;

a plurality of radiation units, each of the radiation units comprising a first radiator and a second radiator; and a reflection portion;

wherein the first radiator is positioned on the first surface and comprises a first radiation portion and a feed point, the feed point is electrically connected to the first radiation portion to feed electrical currents and signals to a corresponding one of the radiation units, wherein the second radiator is positioned at the second surface and is symmetrical with the first radiator about the substrate, the second radiator comprises a second radiation portion and a ground portion, the ground portion is electrically connected to the second radiation portion to provide grounding for the radiation unit; and wherein the reflection portion is made of metal material and is positioned spaced apart from the second surface.

10. The wireless communication device of claim 9, wherein the first radiator further comprises a plurality of first isolation portions, the second radiator comprises a plurality of second isolation portions, the plurality of first isolation portions is spaced from the first radiation portion and is positioned around a periphery of the first radiation portion, and wherein the plurality of second isolation portions is spaced from the second radiation portion and is positioned around a periphery of the second radiation portion.

11. The wireless communication device of claim 10, wherein the first radiation portion comprises four resonance arms, each resonance arm comprises a first resonance section and a second resonance section, one end of the second resonance section is vertically connected to one end of the first resonance section, other ends of each second resonance section away from the first resonance section are connected with each other, and wherein the feed point is positioned at a junction of the second resonance sections.

12. The wireless communication device of claim 11, wherein each of the second resonance sections is perpendicular to the other two adjacent second resonance sections, two second resonance sections of the first radiation unit are positioned in a diagonal direction of the substrate, one end of each of the first resonance sections away from the end of the second resonance section faces the same side in a counterclockwise direction or a clockwise direction.

13. The wireless communication device of claim 11, wherein a number of the plurality of isolation portions is four, each of the plurality of isolation portions is positioned at the side of the first resonance section away from the second resonance section to parallel to the first resonance section.

14. The wireless communication device of claim 13, wherein a length of the first resonance section is less than a length of the second resonance section, a width of the first resonance section is greater than a width of the second resonance section, a length of the first isolation portion is approximately equal to the length of the first resonance section.

15. The wireless communication device of claim 11, wherein a structure of the second radiation portion is the same as that of the first radiation portion.

16. The wireless communication device of claim 9, wherein a number of the plurality of radiation units is four, the four radiation units are positioned at four corners of the substrate, two radiation units located in the same diagonal direction of the substrate are symmetrical with respect to a center point of the substrate.

* * * * *